US007484708B1

(12) United States Patent
Jessee

(10) Patent No.: US 7,484,708 B1
(45) Date of Patent: Feb. 3, 2009

(54) MOLD ASSEMBLY FOR THE PRODUCTION OF CONCRETE BLOCKS

(76) Inventor: Allen W. Jessee, 10980 Richardson Rd., Ashland, VA (US) 23005

( * ) Notice: Subject to any disclaimer, the term of this patent is extended or adjusted under 35 U.S.C. 154(b) by 150 days.

(21) Appl. No.: 11/273,569

(22) Filed: Nov. 15, 2005

(51) Int. Cl.
*B28B 7/00* (2006.01)

(52) U.S. Cl. ..... 249/61; 249/163; 425/253; 425/470

(58) Field of Classification Search ..... 249/119, 249/163, 98, 120, 139, 134, 99, 101; 425/253, 425/470, DIG. 12; 264/317
See application file for complete search history.

(56) References Cited

U.S. PATENT DOCUMENTS

| | | | | | |
|---|---|---|---|---|---|
| 304,976 | A | * | 9/1884 | Taylor | 249/134 |
| 990,437 | A | * | 4/1911 | Hartley | 249/101 |
| 2,819,495 | A | * | 1/1958 | Krausz | 264/245 |
| 3,334,857 | A | * | 8/1967 | Liptrap | 249/119 |
| 3,389,195 | A | * | 6/1968 | Gianakos et al. | 264/45.4 |
| 3,461,749 | A | | 8/1969 | Gagne | |
| 3,545,152 | A | * | 12/1970 | Knohl | 52/367 |
| 3,692,458 | A | * | 9/1972 | Kirsch | 425/469 |
| 3,703,572 | A | * | 11/1972 | Bellasalma | 264/510 |
| 3,773,879 | A | * | 11/1973 | Munsil et al. | 264/54 |
| 4,111,627 | A | | 9/1978 | Kitahara | |
| 4,218,206 | A | | 8/1980 | Mullins | |
| 4,261,693 | A | * | 4/1981 | Rayner et al. | 425/431 |
| 4,359,443 | A | * | 11/1982 | Michaels | 264/328.2 |
| 4,379,687 | A | * | 4/1983 | Wilson et al. | 425/388 |
| 4,389,036 | A | | 6/1983 | Abou-Ezzeddine | |
| 4,426,002 | A | * | 1/1984 | Rez | 206/523 |
| 4,440,377 | A | * | 4/1984 | Hujik | 249/119 |
| 4,665,673 | A | * | 5/1987 | Diana | 52/314 |
| 4,723,750 | A | * | 2/1988 | Clark, III | 249/111 |
| 4,987,944 | A | * | 1/1991 | Parks | 164/10 |
| 5,197,527 | A | | 3/1993 | Namba et al. | |
| 5,219,591 | A | | 6/1993 | Allison et al. | |
| 5,370,353 | A | * | 12/1994 | Billson | 249/120 |
| 5,395,228 | A | | 3/1995 | Aeseth et al. | |
| 5,397,225 | A | * | 3/1995 | Knipp et al. | 425/4 R |
| 5,556,228 | A | * | 9/1996 | Smith | 405/16 |
| 5,580,507 | A | * | 12/1996 | Williamson et al. | 264/221 |
| 5,587,183 | A | * | 12/1996 | Clark et al. | 425/4 R |
| D383,473 | S | * | 9/1997 | Wood | D15/135 |
| 5,667,741 | A | * | 9/1997 | Tabata et al. | 264/54 |
| 5,686,009 | A | | 11/1997 | Gregersen | |
| 5,906,456 | A | * | 5/1999 | Knight | 405/20 |
| 6,007,321 | A | | 12/1999 | Meckel et al. | |
| 6,079,902 | A | * | 6/2000 | Pettee, Jr. | 405/35 |

(Continued)

FOREIGN PATENT DOCUMENTS

DE 4040905 A1 * 3/1992

(Continued)

*Primary Examiner*—Philip C Tucker
*Assistant Examiner*—Dimple N Bodawala
(74) *Attorney, Agent, or Firm*—Norman B. Rainer

(57) ABSTRACT

A mold assembly for making concrete blocks includes a billet of foamed polystyrene having flat upper and lower surfaces, and having apertures produced by a CNC milling machine. The apertures are bounded by perimeter walls of varied contour orthogonally disposed to the flat surfaces of the billet. The bottom surface of the billet is secured to a flat rigid floor panel. Blocks are produced by pouring concrete into the aperture, allowing the concrete to harden, then breaking the polystyrene away from the blocks formed within the apertures.

2 Claims, 3 Drawing Sheets

U.S. PATENT DOCUMENTS 6,086,037 A * 7/2000 Nagy et al. ..... 249/91
6,361,725 B1 * 3/2002 Sinsley ..... 264/87
6,446,697 B1 9/2002 Shaikh et al.
6,524,677 B1 * 2/2003 Bechtold ..... 428/57
7,048,250 B2 * 5/2006 Mothes ..... 249/52
2005/0136148 A1 * 6/2005 Martin ..... 425/458

FOREIGN PATENT DOCUMENTS

JP 61254309 A * 11/1986
JP 04070305 A * 3/1992
WO WO 2051603 A2 * 7/2002

* cited by examiner

MOLD ASSEMBLY FOR THE PRODUCTION OF CONCRETE BLOCKS

BACKGROUND OF THE INVENTION

1. Field of the Invention

This invention relates to the manufacture of molded concrete products, and more particularly concerns a mold for producing block structures of varied design.

2. Description of the Prior Art

Specialized concrete blocks find widespread use in constructions that provide unique appearances while fulfilling functional requirements. For example "paver blocks" are generally employed by emplacement upon substantially flat ground surfaces in abutting relationship to produce walkways, patio areas, or decorative flooring. Such paver blocks are generally configured as monolithic molded pieces having substantially flat upper and lower faces in parallel juxtaposition spaced apart by about 2 to 4 inches, and bordered by a perimeter sidewall that extends orthogonally between said upper and lower faces.

In conventional paver blocks, the perimeter sidewall is of rectangular shape. This invention is concerned with paver blocks and related concrete blocks having sidewalls of non-rectangular contoured shapes adapted to interact with contiguous blocks in tight fitting abutment to produce an aesthetically pleasing and functionally sound flat assemblage. Such blocks of customized shapes are further useful in filling floor or wall areas having irregular boundaries such as triangular or other polygonal shapes.

The production of blocks molded from concrete is well known. In a typical block-molding operation, pourable concrete is entered by downward gravity flow into an underlying mold structure of generally elongated, flat contour having a multitude of identical cavities with open upper extremities. When filled with concrete to the height of the upper extremity of each cavity, the lower, generally flat bottom of the cavity produces the lower surface of the resultant block, and the upper surface of the concrete becomes the upper face of the block. Immediately after the concrete is poured into the cavities, the mold is vibrated so as to deaerate the still fluid concrete and cause the upper surface in each cavity to be level and smoothly formed.

The mold, generally positioned upon a pallet, is then removed and allowed to stand motionless until the concrete sets to a hardened structure. The resultant blocks are extricated from the mold, and the mold, generally of strong metal construction, is repeatedly used again. Examples of such traditional block-making processes are disclosed in U.S. Pat. Nos. 5,219,591; 5,686,009; 6,007,321; 4,218,206; 5,395,228; and 4,111,627.

U.S. Pat. No. 4,389,036 discloses the manufacture of concrete blocks having hollow interiors. Such blocks are made by providing conically shaped inserts centrally positioned within the mold cavities. Upon solidification of the concrete, the inserts, which may be of plastic construction, are removed.

In the molding of metal objects by the "lost foam" process, pieces of foamed polymer such as polystyrene are shaped to have the exact configuration of the intended molded object. The shaping of the polymer foam may be done by automatic CNC cutting machines. The shaped structure is then embedded within a bed of foundry sand. When molten metal is poured into the cavity occupied by the shaped foam, the foam is vaporized. Upon cooling and solidification and removal of the enveloping sand, a molded object is obtained which has the exact shape as the precursor shaped polystyrene foam.

The aforesaid techniques are not amenable to the short run production of shaped concrete articles, particularly where a mold is used just once for the production of custom designed blocks of varied and unusual configurations.

It is accordingly an object of the present invention to provide a process for the production of concrete blocks of varied configuration.

It is another object of this invention to provide a mold assembly suitable for use in the aforesaid process.

It is a further object of the present invention to provide a process for the fabrication of accurate and varied low cost molds for the production of concrete paver blocks.

These objects and other objects and advantages of the invention will be apparent from the following description.

SUMMARY OF THE INVENTION

The above and other beneficial objects and advantages are accomplished in accordance with the present invention by a mold assembly comprised of a) a monolithic mold of foamed polystyrene, said mold having a configuration defined by flat upper and lower surfaces in parallel juxtaposition spaced apart by a continuous outer boundary sidewall, and a number of apertures, each defined by a circuitous perimeter sidewall orthogonally disposed to said upper and lower surfaces, said perimeters being of varied contour amongst the number of apertures and spaced apart at least one inch from contiguous apertures, b) a flat rigid floor panel adapted to securely engage the lower surface of said mold, and c) releasable securing means for urging said floor panel against the lower surface of said mold.

The apertures are produced employing a CNC milling machine. In the process of utilizing said mold, fluid concrete is poured into the apertures, and the mold assembly is vibrated to facilitate removal of air bubbles and to produce a level top surface. The mold assembly, containing the concrete is allowed to stand motionless until the concrete sets to a solid state. The mold is then broken apart to retrieve the concrete articles, and the remnants of the mold are discarded.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
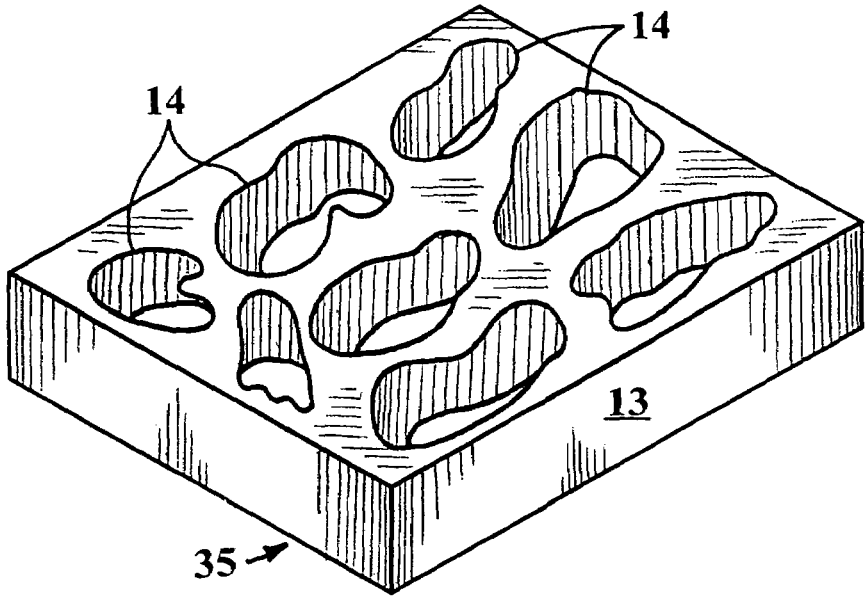
FIG. 1 is a top perspective view of an embodiment of the mold component of the present invention.
Figure 2:
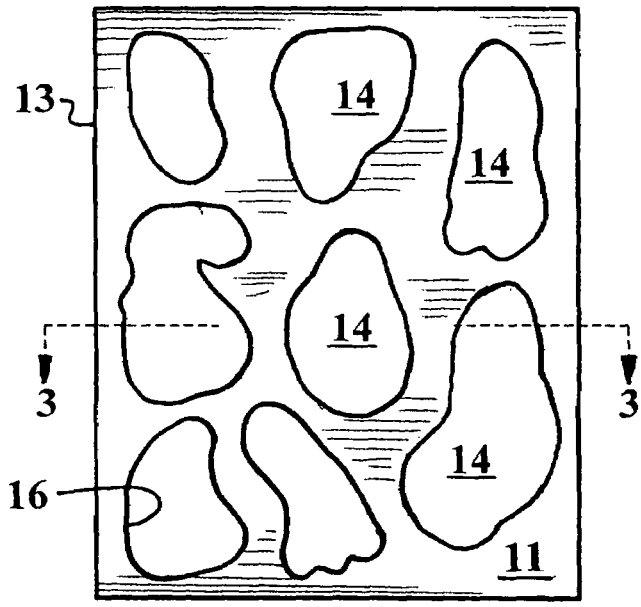
FIG. 2 is a top view of the embodiment of FIG. 1.
Figure 3:
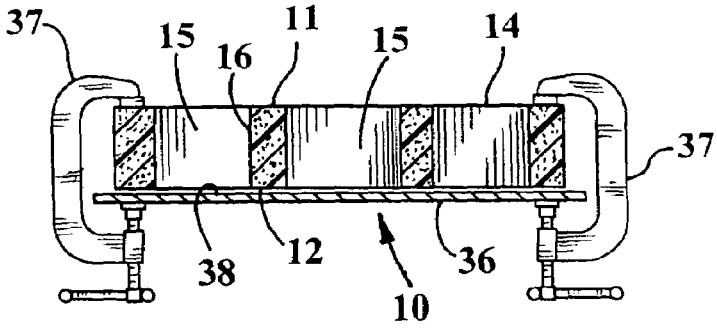
FIG. 3 is a sectional view taken in the direction of the arrows upon the line 3-3 of FIG. 2, and further showing the floor panel and securing components of the mold assembly of this invention.

Referring now to FIGS. 1-3, an embodiment of the mold assembly 10 of the present invention is shown comprised of mold 35 overlying floor panel 36, and securing means 37 interactive between said mold and floor panel.

Mold 35 is a monolithic billet of foamed polystyrene, having a configuration defined by flat upper and lower surfaces 11 and 12, respectively, in parallel juxtaposition and spaced apart by a continuous boundary sidewall surface 13 of rectangular contour. The billet has a uniform thickness of between 2 and 4 inches, and has a bulk density of about 1 lb/cu. ft. A plurality of apertures 14 penetrate said billet. Each cavity is bounded by a circuitous perimeter sidewall 16 orthogonally disposed to said upper and lower surfaces. The perimeters of said cavities are of varied contour amongst the plurality of cavities, and spaced apart at least one inch from contiguous cavities.

The polystyrene foam billet employed for producing the mold of the present invention is produced from medium molecular weight polystyrene in bead form containing about 5%-8% of a blowing agent such as pentane. The beads are entered into a mold which is then heated to produce expansion of the beads with cohesive joinder of contiguous expanded beads to form a monolithic structure. The beads may further contain additives which control cell size and degree of cohesion. Polystyrene billets produced in this manner may have bulk densities as low as one pound/cubic foot.

Floor panel 36 is a flat rigid structure having outer dimensions adequate to accommodate the overlying polystyrene mold. Said panel may be an independent unit or may be the top of a table having underlying support legs. The releasable securing means 37 may be adjustable c-clamps or furniture clamps, or may be adhesive tape of sufficient length to extend from below panel 36 to upper surface 11 of mold 35.

Figure 4:
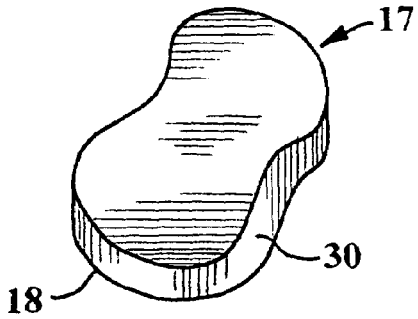
FIG. 4 is a top perspective view of a paver block produced by the mold of FIG. 1.

A typical paver block 17 produced by the process and mold assembly of this invention is shown in FIG. 4. The lowermost surface 18 of block 17 corresponds to the top surface 38 of floor panel 36 interactive with an aperture 14, and the edge contour 30 and block thickness corresponds to the perimeter sidewall 16 of said aperture.

Figure 5:
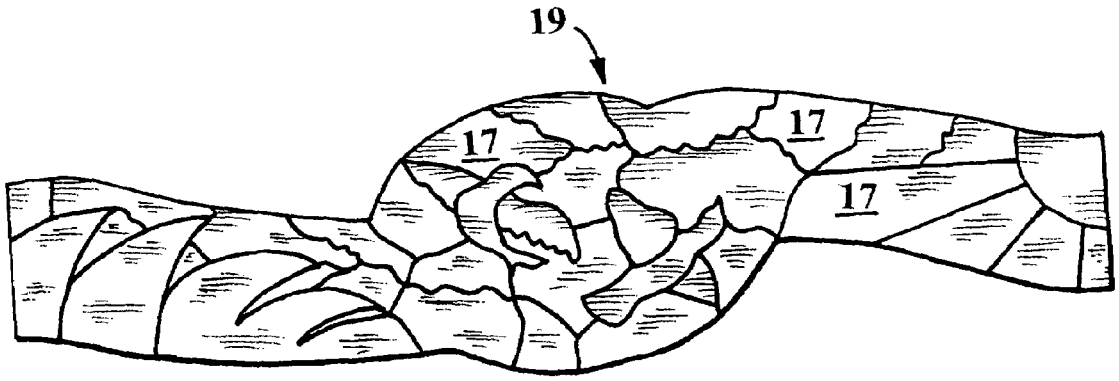
FIG. 5 is a top view of a walking path made from paver blocks produced by the mold of FIG. 1.

A walkway path 19 constructed of blocks 17 of the aforesaid nature is shown in FIG. 5. Said path is produced by the interactive abutment of designated specific blocks in the manner of a jigsaw puzzle. In such manner, pathways, patios, driveways and other ground cover structural layers of varied appearance can be produced often without the need for intervening bonding agents such as mortar. Such tight-fitting interengagement of the blocks is achieved by causing the space between the mating blocks to be between 0.20 and 0.40 inch at all locations about their varied perimeters.

Figure 6:
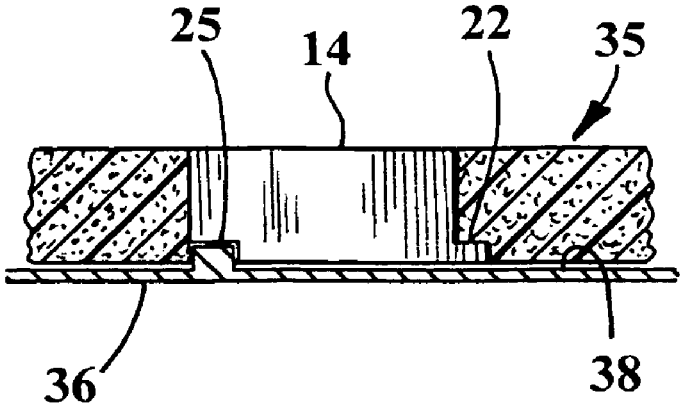
FIG. 6 is a fragmentary vertical sectional view of another embodiment of the mold assembly of this invention.
Figure 7:
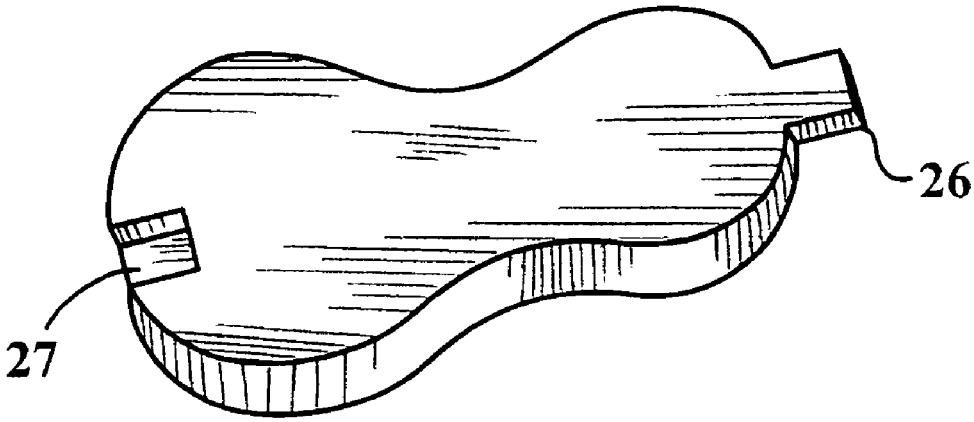
FIG. 7 is a bottom perspective view of a block produced from the mold assembly of FIG. 6.

Referring now to FIG. 6, a mold is shown wherein each aperture 14 has a lateral recess 22 formed as a continuous extension of perimeter sidewall 16 at the lowest portion thereof. Protuberances 25 of matching shape to a corresponding recess are adhesively positioned upon upper surface 38 of panel 36 in opposition to a corresponding recess 22. When the concrete is poured into the apertures and then solidified, each recess 22 forms a tab 26 outwardly directed from the paver block, and the matching protuberance forms a socket 27 which receives the tab of a contiguous block.

In the block making process of this invention, an artistic or geometric pattern is entered into a CNC milling machine. The milling machine is then caused to cut appropriate apertures into a polystyrene billet of 2 to 4 inch thickness, allowing at least one inch between contiguous apertures and the boundary sidewall of the billet. The apertured billet, constituting the mold, is secured to panel 36. Concrete is poured into the apertures, and vibration is applied to the mold assembly to achieve settling of the concrete with deaeration. Once hardened, the resultant concrete blocks are removed by the destruction of the polystyrene mold.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A mold assembly for the production of a multitude of concrete paver blocks of varied contour, said mold assembly comprised of a) a monolithic mold fabricated of foamed polystyrene having a density of about 1 pound per cubic foot and easily destructable following one time use, said mold having a configuration defined by flat upper and lower surfaces in parallel juxtaposition spaced 2 to 4 inches apart by a continuous outer boundary sidewall, and a number of apertures produced by a CNC milling machine, each aperture defined by a circuitous perimeter sidewall orthogonally disposed to said upper and lower surfaces, said perimeters being of varied contour amongst the number of apertures and spaced apart at least one inch from contiguous apertures, said varied contour being such as to produce concrete blocks which fit together in the nature of a jigsaw puzzle with a uniform gap between contiguous blocks of 0.20 to 0.40 inch, b) a flat rigid floor panel adapted to securely engage the lower surface of said mold, and c) releasable securing means for urging said floor panel against the lower surface of said mold.

2. The mold assembly of claim 1 wherein each aperture has a lateral recess formed as a continuous extension of said perimeter sidewall at the lowest portion thereof, and protuberances of matching shape to a corresponding recess are positioned upon said floor panel in opposition to a corresponding recess, thereby producing blocks having an outwardly directed tab and a matching socket which interlockingly receives the tab of a contiguous block.

* * * * *